US008424566B2

(12) United States Patent
Merchant et al.

(10) Patent No.: US 8,424,566 B2
(45) Date of Patent: Apr. 23, 2013

(54) APPARATUS AND SYSTEMS TO CONTROL A FLUID

(75) Inventors: Laxmikant Merchant, Karnataka (IN); Jitendra Harish Bijlani, Karnataka (IN); Robert L. Baran, Amsterdam, NY (US); Venkateswara Rao Akana, Karnataka (IN)

(73) Assignee: General Electric Company, Schenectady, NY (US)

( * ) Notice: Subject to any disclaimer, the term of this patent is extended or adjusted under 35 U.S.C. 154(b) by 506 days.

(21) Appl. No.: 12/537,372

(22) Filed: Aug. 7, 2009

(65) Prior Publication Data

US 2011/0030821 A1 Feb. 10, 2011

(51) Int. Cl.
*B67D 7/58* (2010.01)

(52) U.S. Cl.
USPC ..... 137/565.37; 137/590; 137/565.17; 137/574

(58) Field of Classification Search ..... 137/590, 137/565.17, 565.37, 574; 222/464.1, 181.1, 222/181.2, 181.3
See application file for complete search history.

(56) References Cited

U.S. PATENT DOCUMENTS

| | | | | |
|---|---|---|---|---|
| 2,174,354 | A * | 9/1939 | Shields | 222/464.7 |
| 2,632,466 | A * | 3/1953 | Ayers | 137/590 |
| 3,223,039 | A * | 12/1965 | Cowan | 137/386 |
| 3,476,038 | A | 11/1969 | Dicmas | |
| 4,576,197 | A | 3/1986 | Kempers | |
| 4,850,796 | A | 7/1989 | Miller | |
| 5,393,418 | A | 2/1995 | Jackson | |
| 5,833,434 | A * | 11/1998 | Stahle | 415/205 |
| 5,944,070 | A * | 8/1999 | Schmidt et al. | 222/181.2 |
| 6,533,543 | B2 | 3/2003 | Tagomori et al. | |
| 2003/0196705 | A1 * | 10/2003 | Grayson | 137/590 |
| 2008/0187448 | A1 * | 8/2008 | Jones | 417/342 |

OTHER PUBLICATIONS

Padmanabhan, Mahadevan and Larsen, Johannes, Section 10.2 Intake Modeling, Pump Handbook, 1986, pp. 10.39-10.55 (10.52 and 10.53), 3rd. Ed., Macgraw-Hill, New York, USA.

* cited by examiner

*Primary Examiner* — Eric Keasel
*Assistant Examiner* — Seth Faulb
(74) *Attorney, Agent, or Firm* — Armstrong Teasdale LLP

(57) ABSTRACT

A fluid transfer system includes a fluid supply source. The fluid supply source includes at least one wall extending from a floor. The fluid transfer system also includes at least one fluid transfer apparatus positioned within the fluid supply source. The fluid transfer system further includes a fluid control system. The fluid control system includes a plate coupled within the fluid supply source at least partially between the wall and the at least one fluid transfer apparatus. The fluid control system also includes at least one partition extending from the plate between the wall and the at least one fluid transfer apparatus. The at least one partition cooperates with the plate to at least partially direct fluid flow into the at least one fluid transfer apparatus.

15 Claims, 10 Drawing Sheets

APPARATUS AND SYSTEMS TO CONTROL A FLUID

BACKGROUND OF THE INVENTION

The embodiments described herein relate generally to control of fluid transport systems, and more particularly, to methods and apparatus for channeling water to facilitate operation of cooling water systems.

At least some known electric power generation plants include a cooling or circulating water system that is integrated with at least one electric power-producing steam turbine system. Most known steam turbine systems receive steam from a steam generation system and the steam turbine generates electric power using the steam. Many known steam turbine systems discharge spent steam to a condensing unit coupled within circulating water system, wherein the steam is condensed for reuse in the steam turbine system. At least some known cooling water systems include at least one cooling tower and at least one circulating water pump that are each coupled in flow communication with the steam condensing unit.

At least some of the known circulating water pumps induce a swirling action and vortex generation in the vicinity of a suction portion of the pump. However, such swirling at the pump suction may cause an uneven distribution of, and sudden variations of, water pressures and velocities at the pump suction, which may result in a decreased performance of the pump due to a reduction in net positive suction head (NPSH) available to the pump suction. Moreover, such vortices in the vicinity of the pump suction may include submerged vortices that induce pre-swirl, or swirl-like conditions, into the water and may develop into free surface vortices that channel air into the pump suction (i.e., cavitation). Excessive swirling and cavitation may increase noise and/or vibration in the pump which over time, may increase maintenance costs and/or replacement costs. Moreover, known methods for use in reducing swirling and/or vortex generation may provide only limited benefits and are generally expensive.

BRIEF DESCRIPTION OF THE INVENTION

This Brief Description is provided to introduce a selection of concepts in a simplified form that are further described below in the Detailed Description. This Brief Description is not intended to identify key features or essential features of the claimed subject matter, nor is it intended to be used as an aid in determining the scope of the claimed subject matter.

In one aspect, a fluid transfer system is provided. The fluid transfer system includes a fluid supply source. The fluid supply source includes at least one wall extending from a floor. The fluid transfer system also includes at least one fluid transfer apparatus positioned within the fluid supply source. The fluid transfer system further includes a fluid control system. The fluid control system includes a plate coupled within the fluid supply source at least partially between the wall and the at least one fluid transfer apparatus. The fluid control system also includes at least one partition extending from the plate between the wall and the at least one fluid transfer apparatus. The at least one partition cooperates with the plate to at least partially direct fluid flow into the at least one fluid transfer apparatus.

In another aspect, a fluid control device is provided. The fluid control device is positioned a predetermined distance from a fluid transfer apparatus. The fluid control device includes a conical base defining a top center portion and a plurality of vanes inserted within at least a portion of the conical base extending radially outward from the top center portion.

In yet another aspect, a fluid control system is provided. The fluid control system includes a plate coupled within the fluid supply source at least partially between the wall and the at least one fluid transfer apparatus. The fluid control system also includes at least one partition extending from the plate between the wall and the at least one fluid transfer apparatus. The at least one partition cooperates with the plate to at least partially direct fluid flow into the at least one fluid transfer apparatus.

BRIEF DESCRIPTION OF THE DRAWINGS

The embodiments described herein may be better understood by referring to the following description in conjunction with the accompanying drawings.

DETAILED DESCRIPTION OF THE INVENTION

Figure 1:
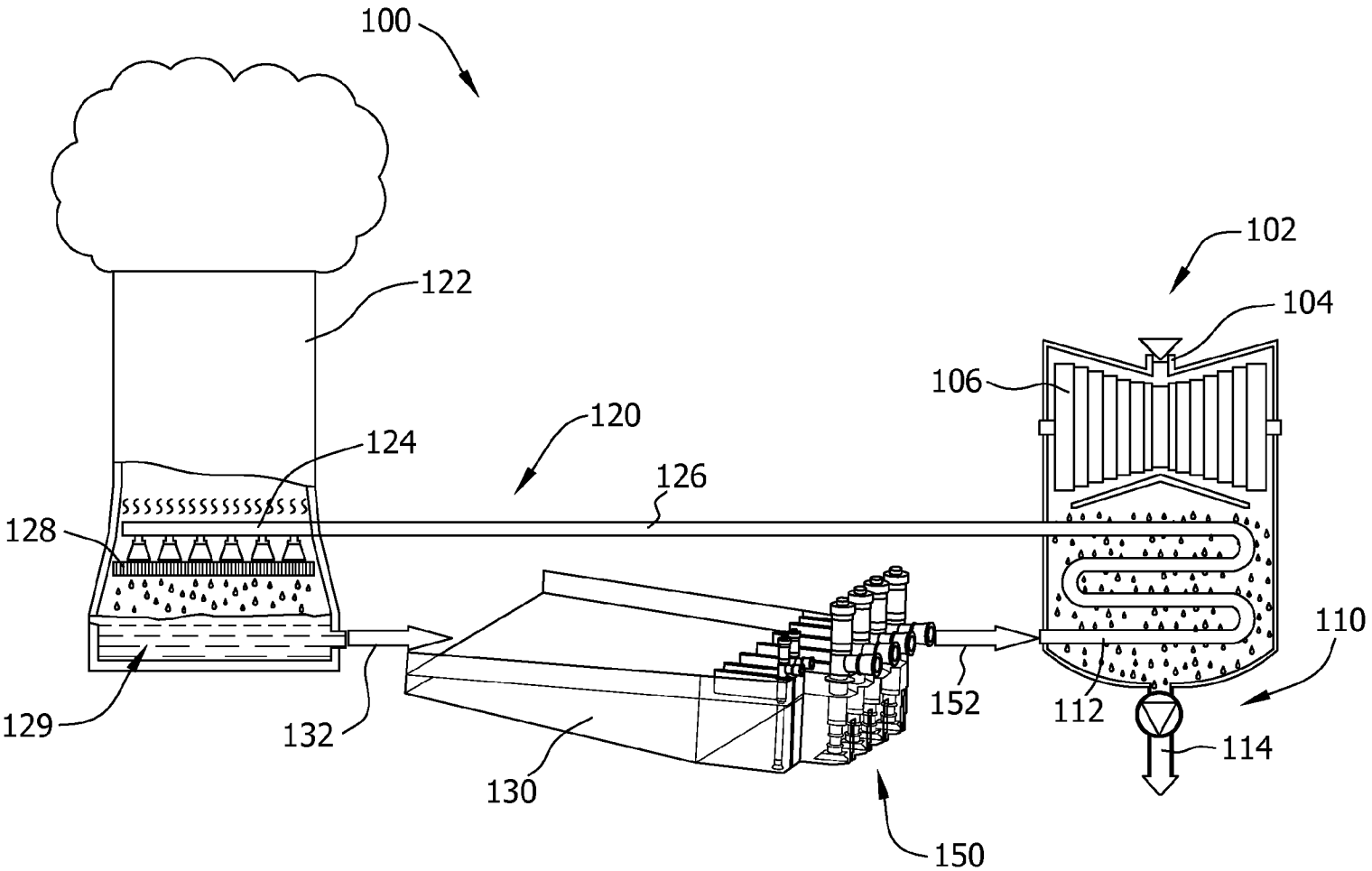
FIG. 1 is a schematic diagram of a portion of an exemplary electric power generation plant.

FIG. 1 is a schematic diagram of a portion of an industrial facility 100 and more specifically, an exemplary electric power generation plant 100. In the exemplary embodiment, electric power generation plant 100 includes a steam turbine system 102 that includes a steam inlet 104 that is coupled in flow communication to a steam generation system (not shown). Steam turbine system 102 also includes a steam turbine assembly 106 that receives steam channeled by steam inlet 104. Steam turbine assembly 106 is coupled to an electric power generator (not shown).

In the exemplary embodiment, electric power generation plant 100 also includes a steam condensing unit 110. Steam condensing unit 110 includes a plurality of condensing tubes 112. Steam condensing unit also includes a condensate outlet 114 that is coupled in flow communication with a condensate/feedwater system (not shown) associated with the steam generation system.

Further, in the exemplary embodiment, electric power generation plant 100 includes a fluid transfer system, or more specifically, a circulating water system 120. In the exemplary embodiment, circulating water system 120 includes at least one cooling tower 122. Circulating water system 120 may include any number and any type of cooling towers 122 that enables circulating water system 120 to function as described herein. Circulating water system also includes a water spray manifold 124 within cooling tower 122, and a warm water conduit 126 that is coupled in flow communication with water spray manifold 124 and condensing tubes 112. In the exemplary embodiment, circulating water system 120 also includes at least one water tray 128 positioned below water spray manifold 124, and a cooling tower basin 129 that is below water tray 128.

Also, in the exemplary embodiment, circulating water system 120 includes a circulating water supply source 130, and more specifically, an exemplary circulating water pump pit 130. A cooled water conduit 132 is coupled in flow communication with cooling tower basin 129 and circulating water pump pit 130. Circulating water system 120 also includes at least one fluid transfer apparatus, or more specifically, in the exemplary embodiment, a plurality of circulating water pumps 150 that are at least partially submerged within circulating water pump pit 130. In the exemplary embodiment, circulating water pumps 150 are centrifugal pumps that have a known NPSH requirement, and circulating water pump pit 130 is at least partially sized to facilitate providing the known NPSH requirement. Circulating water system 120 also includes a pump discharge conduit 152 that is coupled in flow communication with circulating water pumps 150 and condensing tubes 112.

In operation, high-temperature steam (not shown) from the steam generation system is channeled to steam turbine assembly 106 via steam inlet 104. The steam induces rotation of steam turbine assembly 106 that subsequently rotates the electric power generator. Circulating water (not shown) is channeled within condensing tubes 112 and steam discharged from steam turbine assembly 106 is cooled by condensing tubes 112 and condensed into water (not shown) that is channeled from steam condensing unit 110 into the condensate/feedwater system via condensate outlet 114.

Also, in operation, warmed circulating water (not shown) is channeled from steam condensing unit 110 to water spray manifold 124 via warm water conduit 126. Warmed circulating water is discharged from water spray manifold 124 towards water tray 128, wherein water impinges upon water tray 128 and falls into cooling tower basin 129. Warmed circulating water is cooled during transit from water spray manifold 124 to cooling tower basin 129 and is collected within basin 129 in a pool of cooled water (not shown). Cooled water (not shown) is channeled from basin 129 to circulating water pump pit 130 via cooled water conduit 132. Cooled water is stored within circulating water pump pit 130 prior to being channeled into condensing tubes 112 via circulating water pumps 150 and pump discharge conduit 152.

While, in the exemplary embodiment, circulating water system 120 is integrated within electric power generation plant 100, system 120 may be implemented within any industrial facility that enables operation of system 120 as described herein including, but not limited to, food and chemical processing facilities, manufacturing facilities, and air-conditioning systems.

Figure 2:
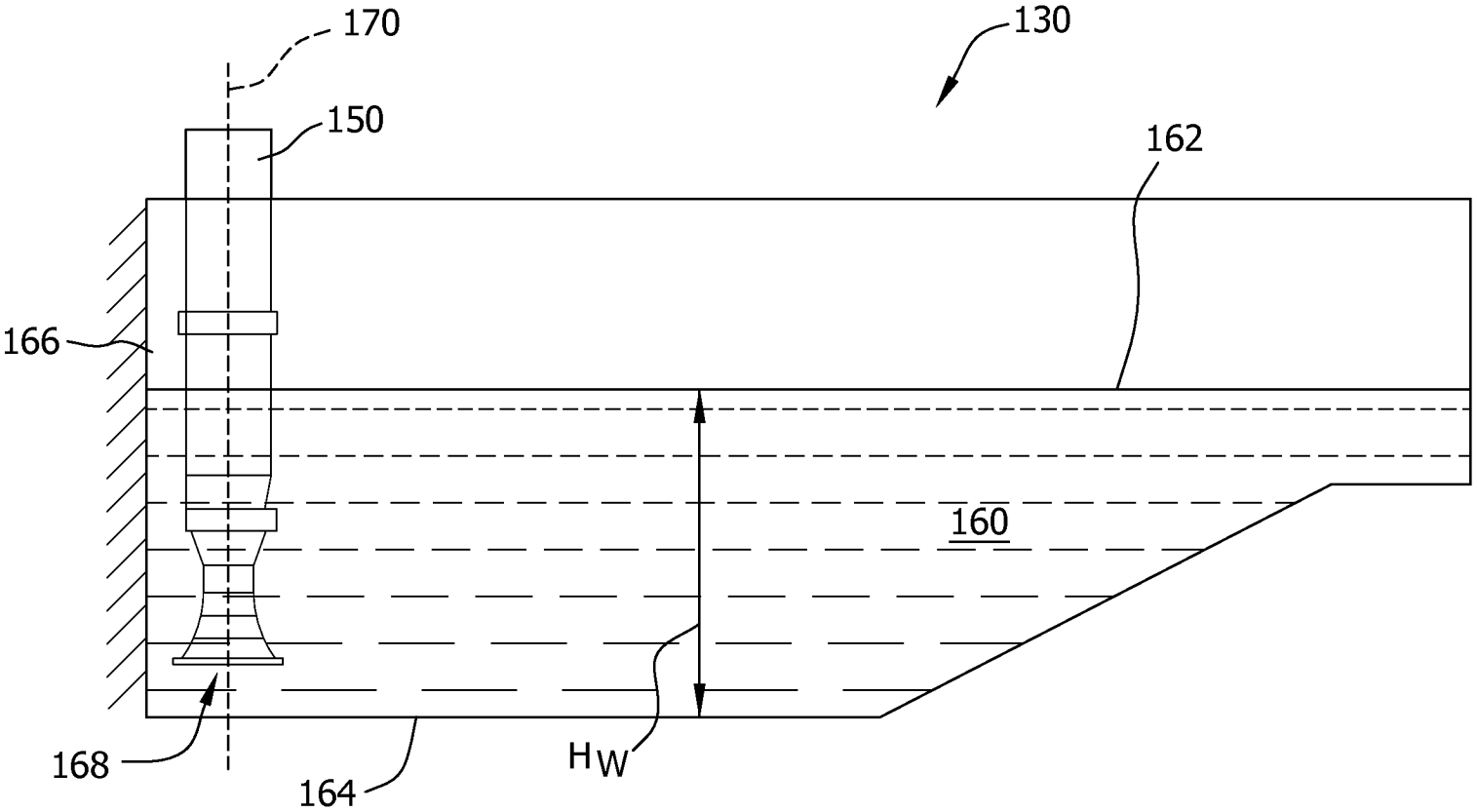
FIG. 2 is a schematic diagram of an exemplary circulating water pump pit that may be used with the electric power generation plant shown in FIG. 1.

FIG. 2 is a schematic diagram of water pump pit 130. During use pit 130 is maintained at least partially filled with water 160 to define a fluid free surface 162, or more specifically, a water line 162 at a height $H_W$ above a pit floor 164. Circulating water pump 150 is positioned within pit 130, is coupled to a pit wall 166, and includes a pump suction portion 168. Pump 150 remains at least partially submerged such that a net positive suction head (NPSH) is available to pump suction portion 168. Pump 150 has an axial centerline 170.

In operation, cooled water 160 is channeled to pit 130 from cooling tower 122 (shown in FIG. 1) as described above. Pit 130 collects water 160 channeled toward pump 150 during operation. Water 160 drawn into pump suction portion 168 is channeled towards steam condensing unit 110 as described above.

Figure 3:
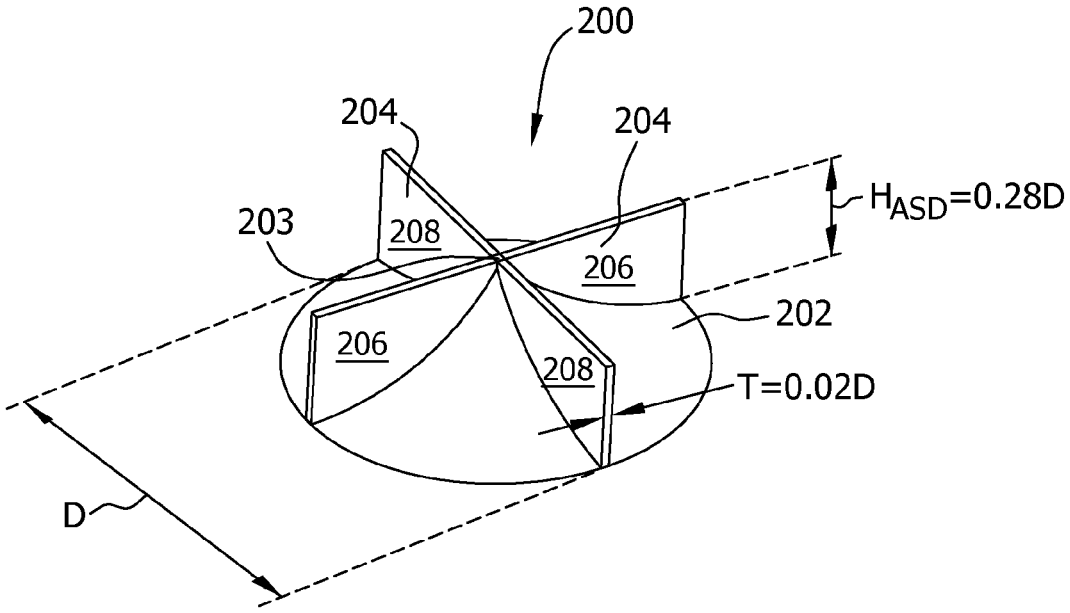
FIG. 3 is a perspective view of an exemplary fluid control device that may be used with the circulating water pump pit shown in FIG. 2.

FIG. 3 is a perspective view of an exemplary fluid control device 2000, or more specifically, a crucicone anti-swirl device 200 that may be used with circulating water pump pit 130 (shown in FIG. 2). In the exemplary embodiment, anti-swirl device 200 includes a conical base 202 having a diameter D. Conical base 202 includes a top center portion 203 that, in the exemplary embodiment, has a height $H_{ASD}$ equal to approximately 0.28 D. Also, in the exemplary embodiment, anti-swirl device 200 includes four vanes 204 that are oriented approximately 90° apart from each other and that each extend radially outward from top center portion 203. Alternatively, anti-swirl device 200 may include any number of vanes 204 in any orientation that enables anti-swirl device 200 to function as described herein, including, but not limited to, three vanes oriented approximately 120° apart and five vanes oriented approximately 72° apart.

In the exemplary embodiment, vanes 204 have a vane thickness T of approximately 0.02 D. Moreover, the in exemplary embodiment a radius of curvature (not shown) of conical base 202 is approximately 0.66 D. In the exemplary embodiment, vanes 204 are formed by intersecting a first substantially rectangular plate 206 and a second substantially rectangular plate 208 within conical base 202 at top center portion 203, thereby forming a substantially cruciform pattern with vanes 204. Alternatively, vanes 204 may be oriented in any pattern that enables anti-swirl device 200 to function as defined herein is used.

Figure 4:
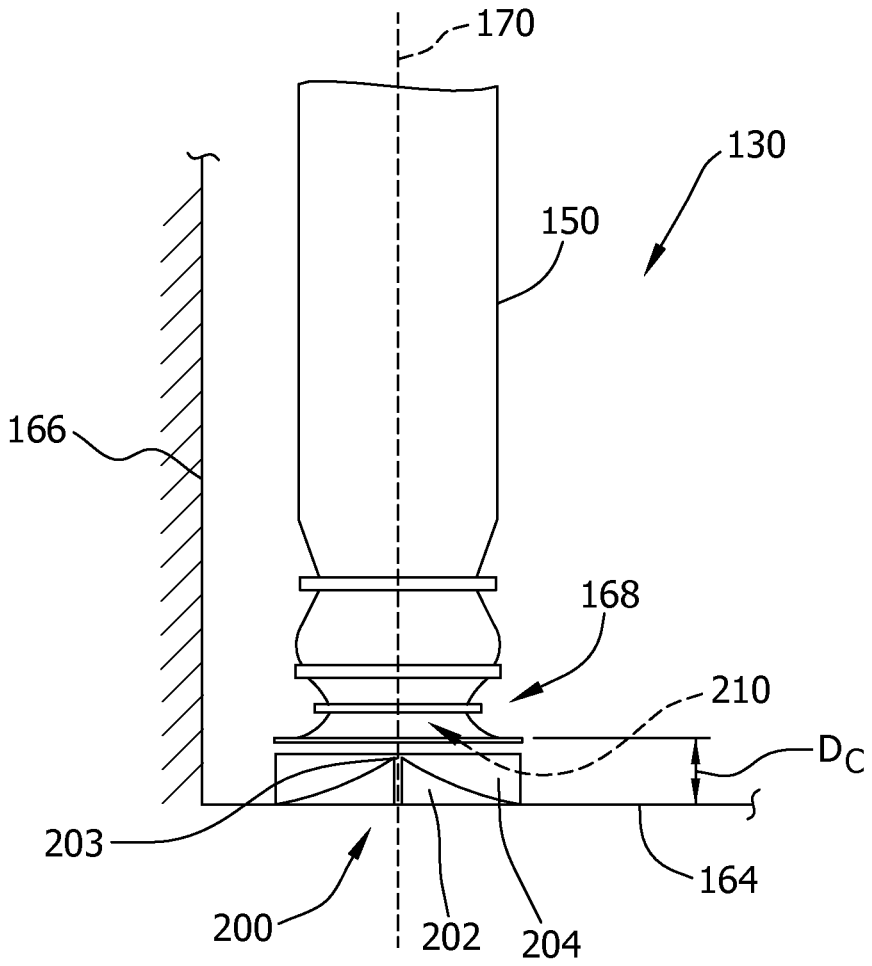
FIG. 4 is a schematic view of the fluid control device shown in FIG. 3.

FIG. 4 is a schematic view of anti-swirl device 200 that is positioned within circulating water pump pit 130. In the exemplary embodiment, anti-swirl device 200 is coupled on floor 164 under pump suction portion 168 such that a clearance distance $D_C$ is defined between floor 164 and pump suction portion 168. Also, in the exemplary embodiment, anti-swirl device 200 extends a distance of approximately $0.8D_C$ from floor 164 to top center portion 203, and pump suction portion 168 is positioned a distance of approximately $0.2\,D_C$ from top center portion 203. In the exemplary embodiment, an equation for determining a diameter D of anti-swirl device 200 is:

$$0.8D_C=H_{ASD}=0.28D \quad \text{(Equation 1)}$$

and, solving for D, $$D=2.857D_C \quad \text{(Equation 2)}$$

wherein diameter D and the other associated dimensions of anti-swirl device 200 are a function of clearance distance $D_C$.

For example, without limitation, in one embodiment of anti-swirl device 200, a clearance distance $D_C$ of approximately 1 meter (m) (3.28 feet (ft)) has a height $H_{ASD}$ of approximately 0.8 m (2.624 ft), a diameter D of approximately 2.857 m (9.37 ft), a vane thickness T of approximately 0.057 m (0.187 ft), and a radius of curvature of approximately 1.89 m (6.18 ft). In such an embodiment, anti-swirl device 200 is coupled to floor 164 with a clearance between anti-swirl device 200 and pump suction portion 168 of approximately 0.2 m (0.656 ft).

In operation, water 160 is drawn towards pump suction portion 168 in a water flow 210. In general, water flow 210 has two vectorial velocity components, that is, a first velocity component that is substantially parallel to pump centerline 170 and a second velocity component that is tangential to the axial component, that is, a tangential velocity component. The tangential velocity component is proportional to a tangential angle measured with respect to axial centerline 170. Also, generally, as the tangential velocity component of water flow 210 increases in relation to the axial velocity component of water flow 210, a potential for pre-swirl conditions to develop increases. Therefore, in the exemplary embodiment, a pre-swirl tangential factor is determined, wherein the pre-swirl tangential factors is substantially equivalent to a ratio of the tangential water velocity value to the axial water velocity value, in the vicinity of anti-swirl device 200. As such, a smaller value for the tangential angle causes a reduced value of the tangential velocity component of water flow 210 as compared to the axial water velocity value of water flow 210, and facilities reducing the potential for pre-swirl conditions to develop in the vicinity of anti-swirl device 200.

In the exemplary embodiment, in operation, water 160 is channeled through anti-swirl device 200, or more specifically, water 160 is channeled into pump suction portion 168 via base 202 and vanes 204. Anti-swirl device 200 facilitates distributing flow of water 210 entering pump suction portion 168 and generally aligns the flow of water 210 towards axial centerline 170 of circulating water pump 150, thereby decreasing a tangential angle of water flow as described above to less than 5° away from axial centerline 170, such that the tangential component of the water velocity is reduced as compared to the increased axial velocity component of water flow 210. As such, a potential for the formation of pre-swirl conditions within water 160 in the vicinity of anti-swirl device 200 is facilitated to be reduced. Inclusion of anti-swirl device 200 reduces the need to modify pump 150.

Figure 5:
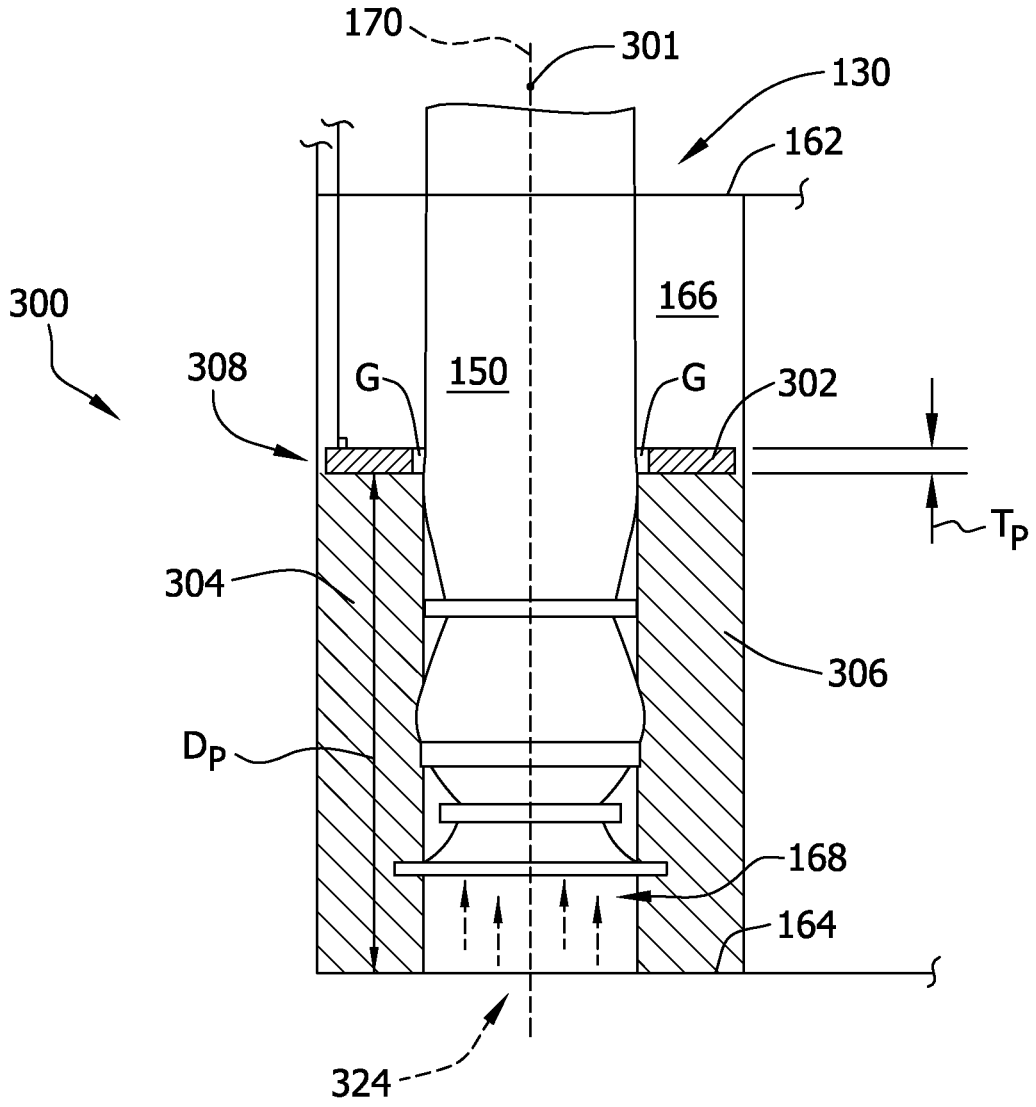
FIG. 5 is a first schematic view of an exemplary fluid control system that may be used with the circulating water pump pit shown in FIG. 2.
Figure 6:
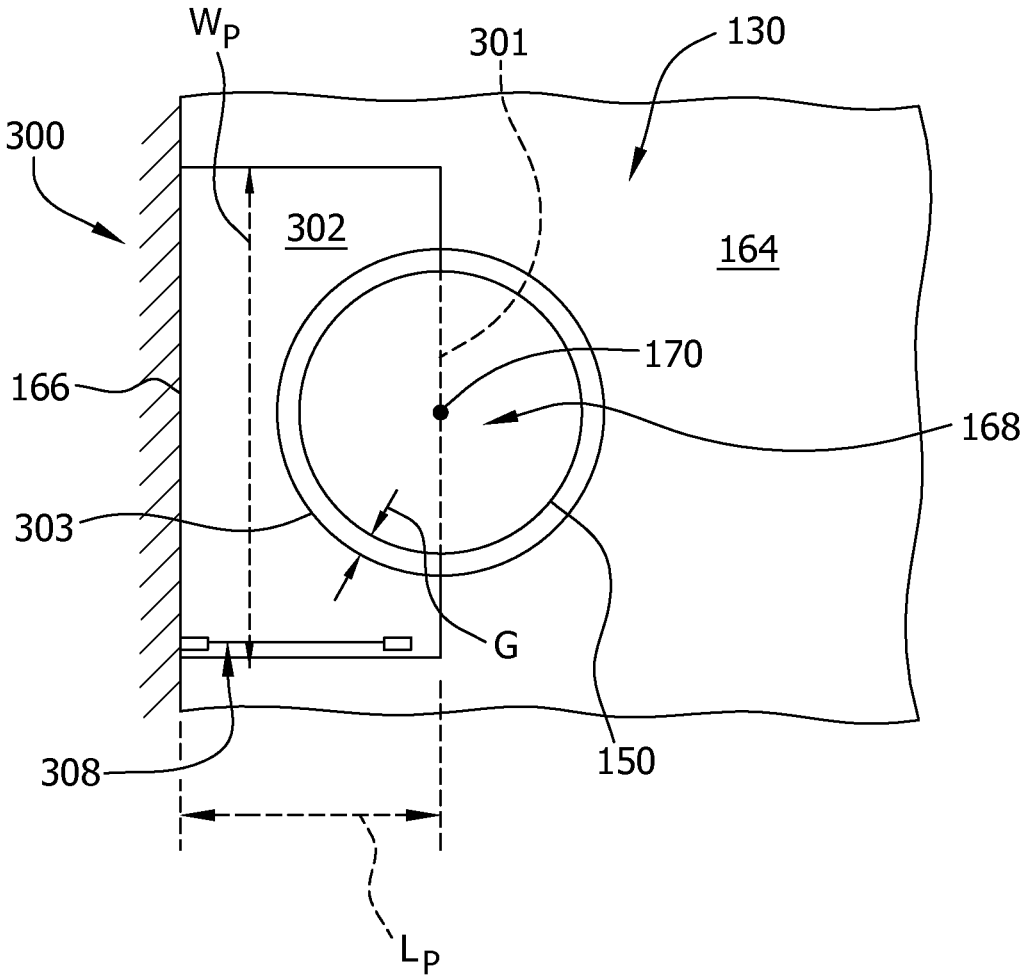
FIG. 6 is an overhead view of the fluid control system shown in FIG. 5.
Figure 7:
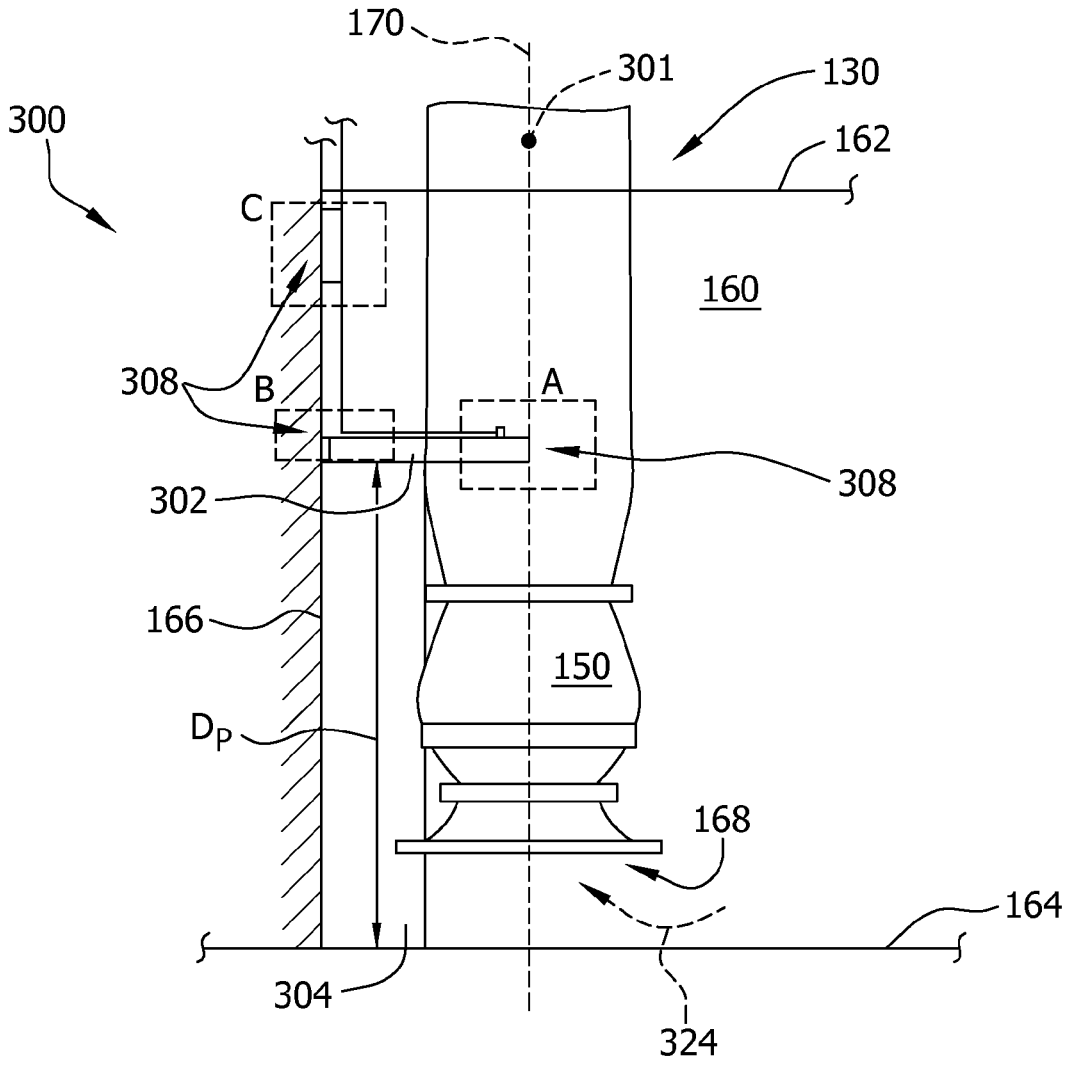
FIG. 7 is a second schematic view of the fluid control system shown in FIGS. 5 and 6.

FIG. 5 is a first schematic view of an exemplary fluid control system 300, or more specifically, an anti-swirl system 300 positioned within circulating water pump pit 130. FIG. 6 is an overhead view of anti-swirl system 300 and FIG. 7 is a second schematic view of anti-swirl system 300. In the exemplary embodiment, anti-swirl system 300 includes a subsurface plate 302 that is coupled within circulating water pump pit 130 such that plate 302 is at least partially supported by pit wall 166.

Also, in the exemplary embodiment, subsurface plate 302 is substantially solid and is mounted substantially horizontally in water 160 below water line 162 at a predetermined distance $D_P$ above pit floor 164. A range of values for distance $D_P$ is determined, wherein at a lower end of the range, pump 150 will likely experience a decrease in NPSH such that pump 150 will require an increase in pumping power to provide sufficient flow, and at the upper end of the range, plate 302 will be substantially less effective in decreasing a potential for swirling. Further, in the exemplary embodiment, plate 302 at least partially defines a pump bifurcation line 301 that is substantially orthogonal to axial centerline 170, wherein at least a portion of plate 302 extends about pump 150 from pump bifurcation line 301 to wall 166.

In the exemplary embodiment, plate 302 is defined by a semicircular edge 303. Alternatively, edge 303 may have any shape that enables anti-swirl system 300 to function as described herein. Exclusive of edge 303, plate 302 has a length $L_P$, a width $W_P$, and a thickness $T_P$, wherein length $L_P$, width $W_P$, and thickness $T_P$ are variably selected to enable operation of anti-swirl system 300 as described herein. A predetermined clearance gap G defined between edge 303 and pump 150 facilitates reducing expansion interference and the transfer of forces from pump 150 to plate 302, and vice versa, wherein gap G has any value that facilitates operation of anti-swirl system 300 as described herein.

Also, in the exemplary embodiment, anti-swirl system 300 includes at least one submerged partition, or more specifically, a first wedge 304 and a second wedge 306. Wedges 304 and 306 are coupled to, and at least partially support, plate 302. Further, in the exemplary embodiment, anti-swirl system 300 also includes a hinge and link mechanism 308, described in more detail in conjunction with areas A, B, and C of FIG. 7.

Figure 8:
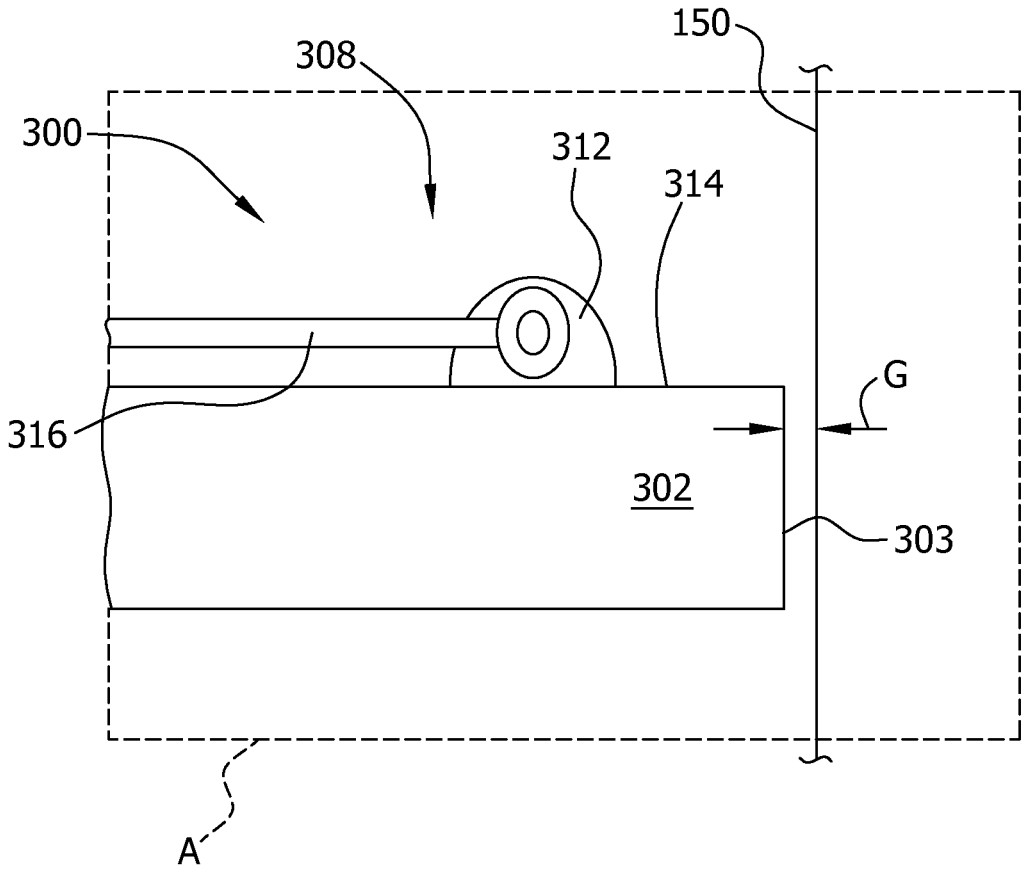
FIG. 8 is a schematic view of details of the fluid control system shown in FIG. 7 taken about area A.

FIG. 8 is a schematic view anti-swirl system 300 taken about area A. In the exemplary embodiment, hinge and link mechanism 308 includes a first hinge 312 coupled to a top portion 314 of plate 302. Also, in the exemplary embodiment, hinge and link mechanism 308 includes a first link 316 that is coupled to hinge 312. Hinge and link mechanism 308 enables plate 302 to shift while maintaining predetermined clearance gap G between edge 303 and pump 150, thus reducing a potential of interference between plate 302 and pump 150. In at least some alternative embodiments, an additional hinge and link mechanism 308 is coupled to an opposite side (not shown) of pump 150.

Figure 9:
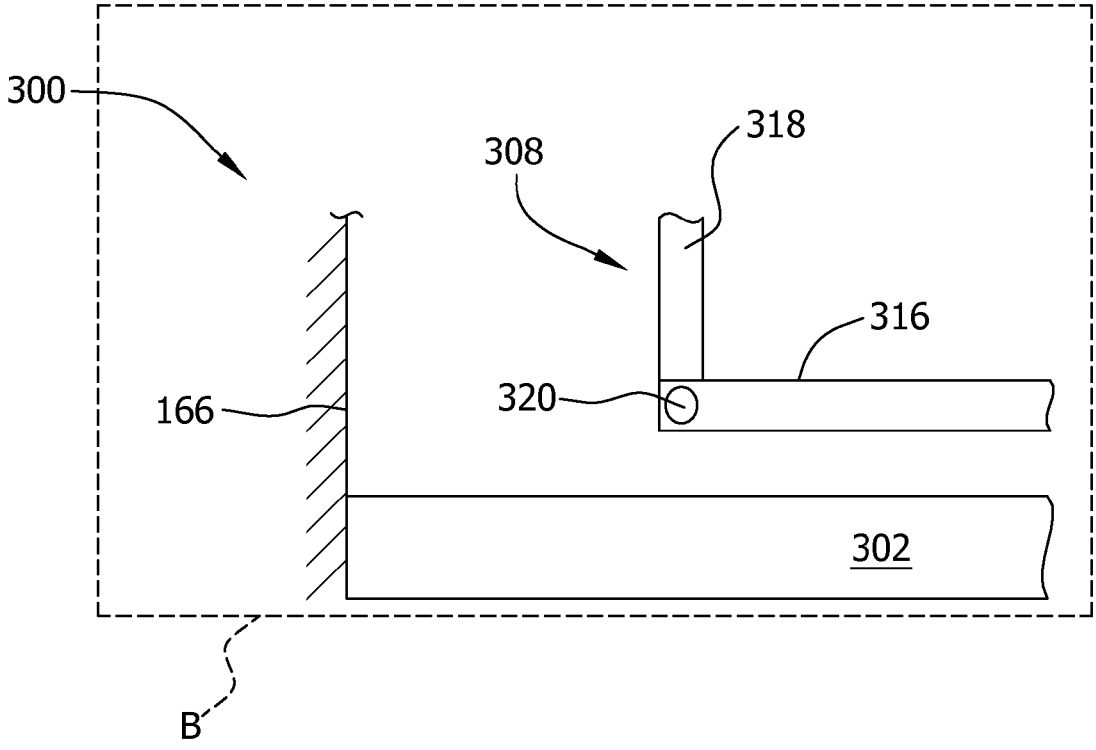
FIG. 9 is a schematic view of details of the fluid control system shown in FIG. 7 taken about area B.

FIG. 9 is a schematic view of anti-swirl system 300 taken about area B. In the exemplary embodiment, hinge and link mechanism 308 includes a second link 318 that is coupled to first link 316 via a second hinge 320. In at least some alternative embodiments, an additional hinge and link mechanism 308 is coupled to an opposite side (not shown) of pump 150.

Figure 10:
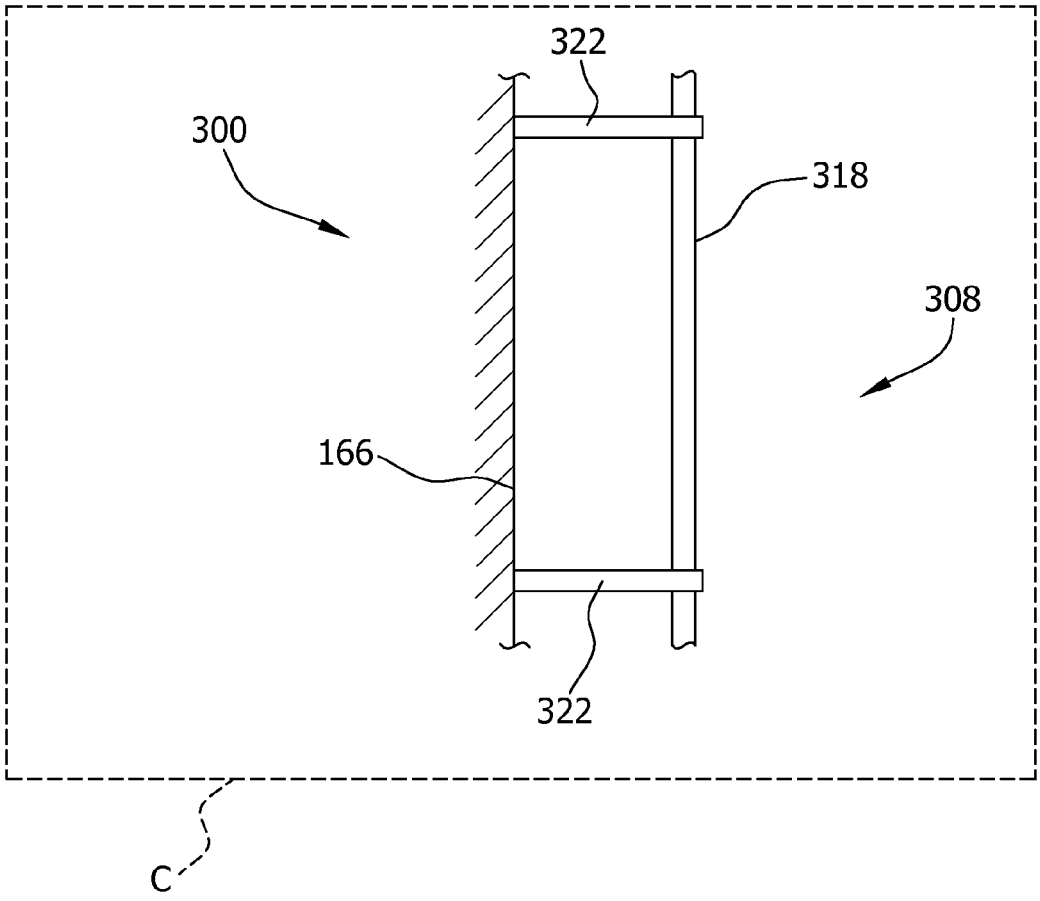
FIG. 10 is a schematic view of details of the fluid control system shown in FIG. 7 taken about area C.

FIG. 10 is a schematic view of details of anti-swirl system 300 taken about area C. In the exemplary embodiment, hinge and link mechanism 308 also includes a plurality of guides 322 coupled to second link 318 and wall 166. Second link 318 extends to an upper portion of wall 166 for any distance and with any number of guides 322 that enables anti-swirl system 300 to function as described herein. In at least some alternative embodiments, an additional hinge and link mechanism 308 is coupled to an opposite side (not shown) of pump 150.

In operation, and referring to FIGS. 5, 6, 7, 8, 9, and 10, water 160 is drawn towards pump suction portion 168 of operating circulating water pump 150 as a water flow 324. In general, a location conducive to formation of air-entraining surface vortices is a region of low free surface velocity, i.e., a flow region (not shown) defined between pump 150 and wall 166. Anti-swirl system 300, and more specifically, plate 302, in cooperation with wedges 304 and 306, facilitates reducing a drawing action by pump 150 on the low velocity region defined between pump 150 and wall 166 towards pump suction portion 168. Such reduced pump drawing in the low velocity region facilitates impeding flow between the top portion of plate 314 and water line 162, and significantly reduces a possibility of vortex formation and subsequent air entrainment to pump suction portion 168. Inclusion of anti-swirl system 300 reduces the need to modify pump 150.

Described herein are exemplary embodiments of apparatus and systems that facilitate controlling fluids, and more specifically, channeling water through cooling, or circulating water systems. Further, specifically, both the anti-swirling device and the anti-swirling system described herein facilitate reducing a tendency for formation of submerged vortices that induce pre-swirl, or swirl-like conditions, and may also develop into free surface vortices that channel air into circulating water pump suction with subsequent cavitation therein. A reduction in swirling and cavitation decreases a potential for noise and/or vibration being induced in the affected pump with a subsequent decrease in inspection costs, repair costs, and/or replacement costs. Moreover, such device and system as described herein facilitates use of a more shallow circulating water pump pit, thereby decreasing a capital cost of construction. Further, use of the anti-swirl device and/or the anti-swirl system as described herein reduces any need for modification to the associated pump.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other assembly packages and methods.

While the invention has been described in terms of various specific embodiments, those skilled in the art will recognize that the invention can be practiced with modification within the spirit and scope of the claims.

What is claimed is:

1. A fluid transfer system comprising:

a fluid supply source comprising at least one wall extending from a floor;

at least one fluid transfer apparatus positioned within said fluid supply source; and a fluid control system comprising:

a plate oriented substantially horizontally within said fluid supply source and at least partially between said at least one wall and said at least one fluid transfer apparatus;

at least one partition coupled to said plate, said at least one partition extending between said plate and said floor and between said at least one wall and said at least one fluid transfer apparatus, said at least one partition cooperates with said plate to at least partially direct fluid flow into said at least one fluid transfer apparatus; and, a fluid control device positioned a predetermined distance from said at least one fluid transfer apparatus, said fluid control device comprising:

a conical base; and a plurality of vanes inserted within at least a portion of said conical base and extending radially outward from said conical base.

2. A fluid transfer system in accordance with claim 1 wherein at least a portion of said plate is defined by an edge having a shape substantially similar to a portion of said at least one fluid transfer apparatus, said edge positioned a distance from said at least one fluid transfer apparatus such that said gap is defined therebetween.

3. A fluid transfer system in accordance with claim 1 further comprising a hinge assembly coupled between at least a portion of said plate and at least a portion of said at least one wall, said hinge assembly facilitates maintaining a gap defined between said plate and said at least one fluid transfer apparatus, said hinge assembly comprises at least one of:

at least one first hinge coupled to a top portion of said plate;

at least one first link coupled to said first hinge;

at least one second hinge coupled to said first link;

at least one second link coupled to said second hinge; and at least one guide coupled to said second link, said at least one guide and said second link coupled to said at least one wall.

4. A fluid transfer system in accordance with claim 1 wherein said plate is at least partially submerged within said fluid supply source.

5. A fluid transfer system in accordance with claim 1 wherein said fluid control device is positioned on said floor below a suction portion of said at least one fluid transfer apparatus, wherein a clearance distance $D_C$ extending between said floor and said suction portion of said at least one fluid transfer apparatus is defined therein, a diameter D of said conical base is a function of the clearance distance $D_C$.

6. A fluid transfer system in accordance with claim 5 wherein said at least one fluid transfer apparatus defines an axial centerline extending therethrough, said fluid control device is positioned to:

increase a portion of water flow directed into said suction portion substantially parallel to the axial centerline; and decrease a portion of water flow directed into said suction portion at least partially tangential to the axial centerline.

7. A fluid control system comprising:

a fluid supply source comprising at least a floor;

at least one fluid transfer apparatus positioned within said fluid supply source and comprising a suction portion positioned a clearance distance $D_C$ from said floor; and a fluid control device positioned on said floor, said fluid control device comprising:

a conical base defining a top center portion; and a plurality of vanes inserted within at least a portion of said conical base, said plurality of vanes coupled to each other such that each of said vanes extends radially outward from said top center portion, wherein said suction portion is positioned a predetermined distance from said top center portion, the predetermined distance being selected based at least partially on clearance distance $D_C$.

8. A fluid control system in accordance with claim 7 wherein said at least one fluid transfer apparatus defines an axial centerline extending therethrough and said fluid control device is positioned to:

increase a portion of water flow directed into said suction portion substantially parallel to the axial centerline; and decrease a portion of water flow directed into said suction portion at least partially tangential to the axial centerline.

9. A fluid control system in accordance with claim 7 wherein said conical base defines at least one of a diameter D of said conical base;

a height $H_{ASD}$ of said conical base that is a function of diameter D;

a thickness T of each of said plurality of vanes that is a function of diameter D; and a radius of curvature of said conical base that is a function of diameter D.

10. A fluid control system in accordance with claim 9 wherein said fluid control device is positioned directly below said suction portion of said at least one fluid transfer apparatus, the diameter D of said conical base is a function of the clearance distance $D_C$.

11. A fluid control system in accordance with claim 7 wherein said plurality of vanes comprises four vanes, each of said plurality of vanes oriented approximately 90° with respect to adjacent vanes of said plurality of vanes.

12. A fluid control system in accordance with claim 11 wherein said plurality of vanes comprise a plurality of intersecting substantially rectangular plates, thereby forming a substantially cruciform pattern.

13. A fluid control system comprising:

a plate oriented substantially horizontally within a fluid supply source and at least partially between a wall and at least one fluid transfer apparatus;

at least one partition coupled to said plate, said at least one partition extending between said plate and a floor and between the wall and the at least one fluid transfer apparatus, said at least one partition cooperates with said plate to at least partially direct fluid flow into the at least one fluid transfer apparatus; and, a hinge assembly coupled between at least a portion of said plate and at least a portion of said at least one wall, said hinge assembly facilitates maintaining a gap defined between said plate and said at least one fluid transfer apparatus, wherein said hinge assembly comprises at least one of:

at least one first hinge coupled to a top portion of said plate;

at least one first link coupled to said first hinge;

at least one second hinge coupled to said first link;

at least one second link coupled to said second hinge; and at least one guide coupled to said second link, said at least one guide and said second link coupled to the wall.

14. A fluid control system in accordance with claim 13 wherein at least a portion of said plate is defined by an edge having a shape substantially similar to a portion of the at least one fluid transfer apparatus, said edge positioned a distance from the at least one fluid transfer apparatus such that said gap is defined therebetween.

15. A fluid control system in accordance with claim 14 wherein said plate edge is substantially semicircular.

* * * * *